US006003467A

United States Patent [19]

Shelton-Ferrell et al.

[11] Patent Number: 6,003,467

[45] Date of Patent: Dec. 21, 1999

[54] DOSAGE INDICATOR

[76] Inventors: Paige Shelton-Ferrell, 3476 Westwood, Salt Lake City, Utah 84109; David Valencia, 1620 North Baker; Anthony J. Bova, P.O. Box 4175, both of Stockton, Calif. 95204

[21] Appl. No.: 08/888,475

[22] Filed: Jul. 7, 1997

[51] Int. Cl.[6] ..... G09F 9/00; B65D 85/00

[52] U.S. Cl. ..... 116/309; 116/308; 116/315; 206/459.1; 215/230

[58] Field of Search ..... 116/308, 309, 116/318, 316, 311, 312, 315; 206/459.1, 459.5; 215/230, 232, 235

[56] References Cited

U.S. PATENT DOCUMENTS

| | | | |
|---|---|---|---|
| 579,474 | 3/1897 | De Barry | 116/308 |
| 2,215,465 | 9/1940 | Ehrlich | 116/315 |
| 2,767,680 | 10/1956 | Lermer | 116/308 |
| 3,996,879 | 12/1976 | Walton | 116/308 |
| 4,347,804 | 9/1982 | Villa-Real | 116/308 |
| 4,365,722 | 12/1982 | Kramer | 215/220 |
| 4,432,300 | 2/1984 | Lyss | 116/308 |
| 4,528,933 | 7/1985 | Allen | 116/308 |
| 4,749,093 | 6/1988 | Trick | 215/220 |
| 4,920,912 | 5/1990 | Kirkling | 116/308 |
| 5,009,338 | 4/1991 | Barker | 215/230 |
| 5,011,032 | 4/1991 | Rollman | 215/230 |
| 5,115,929 | 5/1992 | Buono | 215/220 |
| 5,184,739 | 2/1993 | Kusz | 215/220 |
| 5,332,113 | 7/1994 | Kusler, III et al. | 215/249 |
| 5,386,795 | 2/1995 | Bartholomew | 116/308 |
| 5,520,307 | 5/1996 | Miller et al. | 221/2 |
| 5,660,138 | 8/1997 | Hirsch | 116/308 |
| 5,678,712 | 10/1997 | Rios | 215/220 |
| 5,694,882 | 12/1997 | Marshall | 116/311 |

*Primary Examiner*—Andrew Hirshfeld
*Assistant Examiner*—Richard A Smith
*Attorney, Agent, or Firm*—Zarley, McKee, Thomte, Voorhees & Seas

[57] ABSTRACT

A medication dosage indicator having two portions, a body portion and a cap portion. The body portion includes a circular top wall and a plurality of raised indicator tabs spaced apart in a circular fashion that have indicia corresponding to the day of the week or other unit of time. The cap portion includes a circular upper wall with a plurality of apertures sized and spaced apart to fit in a mating relationship with the indicator tabs.

11 Claims, 4 Drawing Sheets

DOSAGE INDICATOR

BACKGROUND OF THE INVENTION

This invention relates to the field of reminder devices or dosage indicators for medicine and the like. More particularly, this invention relates to a dosage indicator suitable for mounting on a container, such as a medicine or pill bottle, and serving to provide a reminder or temporary record of the date medicine was last taken or is next due.

When required to take medicine on a particular schedule, many people have a problem remembering when the medicine was last taken or is next due. This is often a matter of serious concern depending upon the circumstances and the medication involved. A good example is the use of oral insulin pills which must be taken on a regular daily schedule. Serious health effects can be encountered if more than one pill is taken each day. Adverse effects are also encountered if a pill is not taken each day as required. It is thus not uncommon for persons who take medication on a daily schedule to worry about whether or not they have taken their medication.

One common approach is to keep a paper record, such as on a calendar or otherwise. This approach often proves inadequate, however, as it requires the separate step of marking the calendar or other record separate and apart from handling the medicine container.

It is therefore of utmost importance to provide hospitals, pharmacies, and individuals with a simple, economical and easy to manipulate dosage indicator or reminder. It is also important to have the aforementioned dosage indicator handy for use by travelers as well as for use by office personnel during the administrations of various medications.

Several attempts have been made in the prior art to provide such a device. These devices have usually suffered, however, from one or more shortcomings, including requiring special containers, being elaborate and expensive, and being susceptible of being misread. Furthermore, these prior art devices are structurally different and comparably less effective than the instant invention.

Accordingly, a primary objective of the present invention is the provision of an improved dosage indicator for reminding the user of the time when medicine was last taken or is next due.

A further objective of the present invention is the provision of a dosage indicator that is susceptible of being read accurately and clearly understood.

Another objective of the present invention is the provision of a dosage indicator that ensures that an accurate record will be kept of when medication was last taken or is next due.

Another objective of the present invention is the provision of a dosage indicator that is suitable for replacing the traditional cap of a pill bottle.

A still further objective of the present invention is the provision of a dosage indicator that is esthetically pleasing, economical to manufacture, and durable in use.

These and other objectives will become apparent from the following description of the invention.

SUMMARY OF THE INVENTION

The foregoing objectives are achieved in a preferred embodiment of the invention by a medication dosage indicator that is comprised of two portions, a body portion and a cap portion. The body portion includes a circular top wall and a plurality of raised indicator tabs spaced apart in a circular fashion on the top wall that have indicia corresponding to the days of the week or other unit of time. The cap portion includes a circular upper wall with a plurality of apertures sized and spaced apart to fit in a mating relationship with the indicator tabs of the body portion. An identification mark adjacent one of the apertures is used to identify a particular raised indicator tabs. Indicia on the indicator tab enables the user to quickly and easily identify when the medication was last taken or is next due.

In its preferred form, the cap portion is movable between a closed position and an open position. In the open position the indicator tabs are disposed within the apertures; whereas, in the open position the indicator tabs are disposed beneath the apertures and the cap portion is rotatable about the body portion. By rotating the cap portion while in the open position, the identification mark can be aligned with the identification tab corresponding to either the last or next dosage time.

This body portion of the dosage indicator may also be adapted to fasten to a pill bottle, replacing the cap of the pill bottle. The dosage indicator thus becomes an integral part of the pill bottle.

This invention also includes a method for reminding a person when to take medication. Using the dosage indicator of the present invention, this method includes the steps of identifying the day of the week on the indicator tab corresponding to the identification mark, dispensing the proper medication on the day of the week corresponding to the identification mark, moving the cap portion from the closed position to the open position, rotating the cap portion to identify the next day for dispensing medication, and finally moving the cap portion from the open position to the closed position.

DETAILED DESCRIPTION OF THE INVENTION

Figure 1:
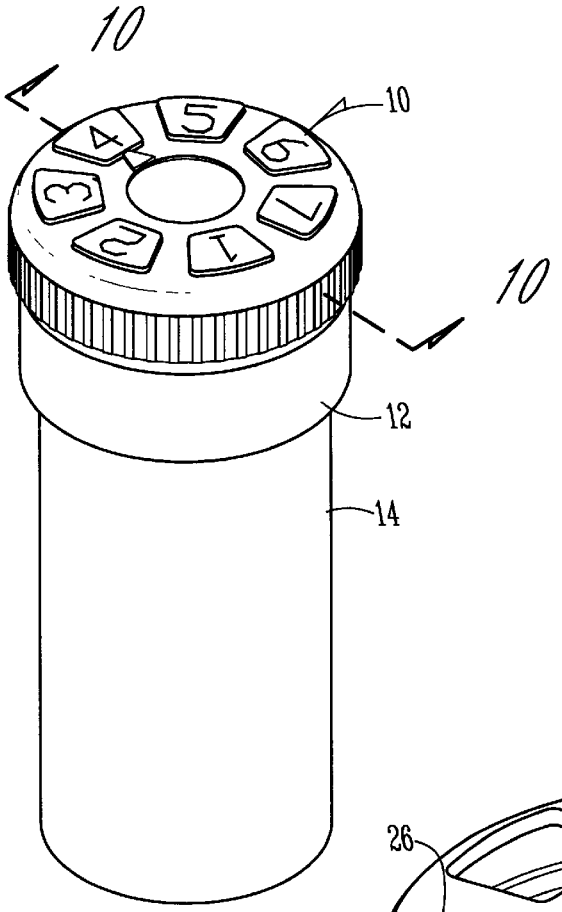
FIG. 1 is a perspective view of the dosage indicator of the present invention mounted to a pill bottle.

With continuing reference to the drawings, a dosage indicator is generally designated by the reference numeral 10. The dosage indicator 10 is suitable for mounting to the cap 12 of a pill bottle 14 (see FIG. 1) or otherwise.

Figure 2:
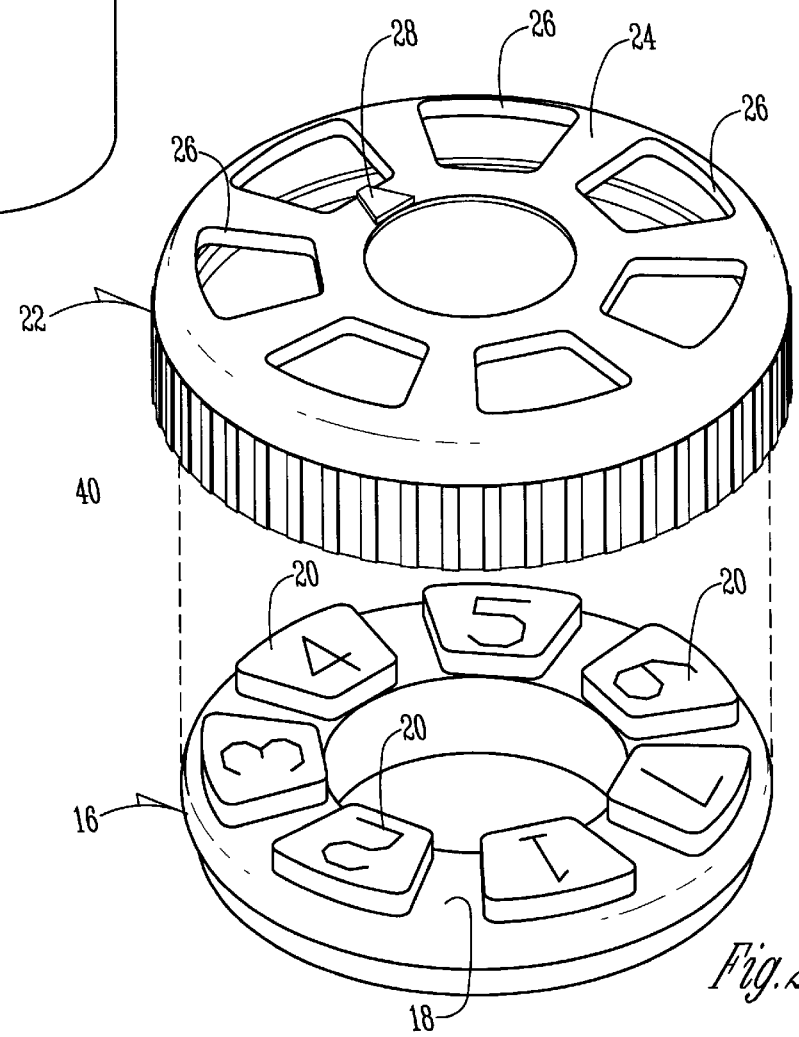
FIG. 2 is an exploded perspective view of the dosage indicator of FIG. 1.

As shown in FIG. 2, the preferred embodiment of the dosage indicator is comprised of two portions, circular in configuration, that matingly fit. One is a body portion 16 having a top wall 18 with a plurality of raised indicator tabs 20 spaced apart in a circular fashion on the top wall. The indicator tabs 20 have indicia for identifying a particular day of the week or other unit of time. Such indicia may include letters and numbers. A cap portion 22 includes a circular upper wall 24 having a plurality of apertures 26 that are sized and spaced apart to fit in mating relationship with the raised indicator tabs 20 on the body portion 16. A raised identification mark 28 is also included on the upper wall 24 of the cap portion 22 adjacent one of the apertures 26. The identification mark 28 serves to identify a particular indicator tab 26 when the cap portion 22 is placed in a mating relationship with the body portion 16.

Figure 3:
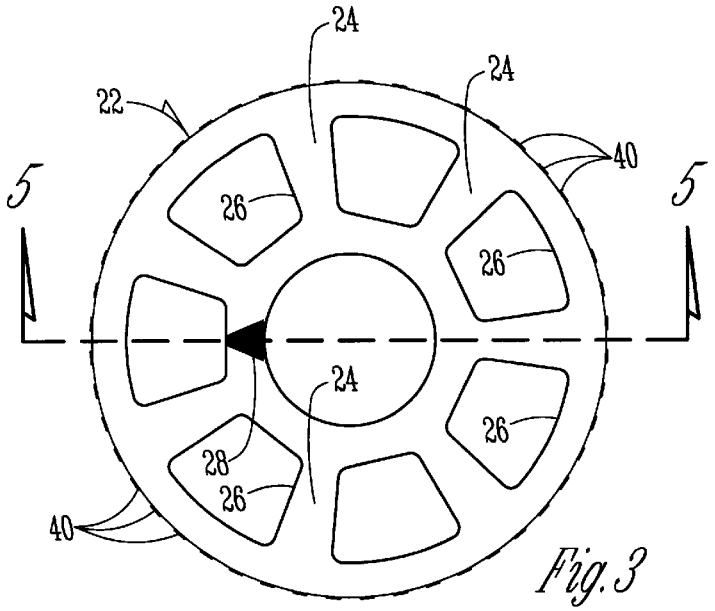
FIG. 3 is a top view of the cap portion of the dosage indicator.
Figure 4:
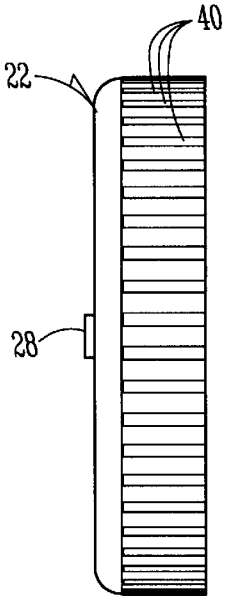
FIG. 4 is a side view of the cap portion of FIG. 3.
Figure 5:
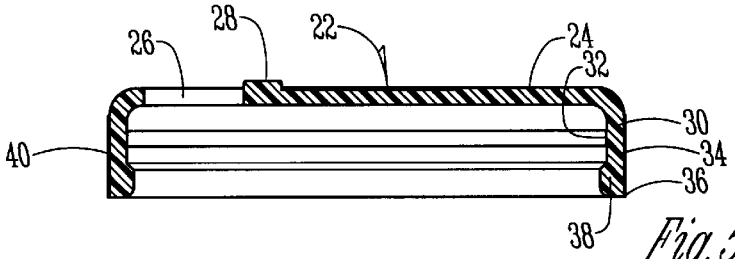
FIG. 5 is a sectional view taken along line 5—5 of FIG. 3.

The cap portion 22 is shown in more detail in FIGS. 3–5. The cap portion 22 has an annular edge 30 that extends from and below the periphery of the upper wall 24. The annular edge 30 has an inner surface 32, an outer surface 34, and a lower end 36. An annular ridge 38 is disposed towards the lower end 36 of the annular edge 30 and extends laterally inward from the inner surface 32. As will be explained in more detail below, the annular ridge 38 serves to secure the cap portion 22 to the body portion 16 of the dosage indicator 10. A plurality of longitudinal ribs 40 are spaced apart on the outer surface 34 of the annular edge 30. The longitudinal ribs 40 provide traction when the cap portion 22 is rotated relative the body portion 16 as described more fully below.

Figure 6:
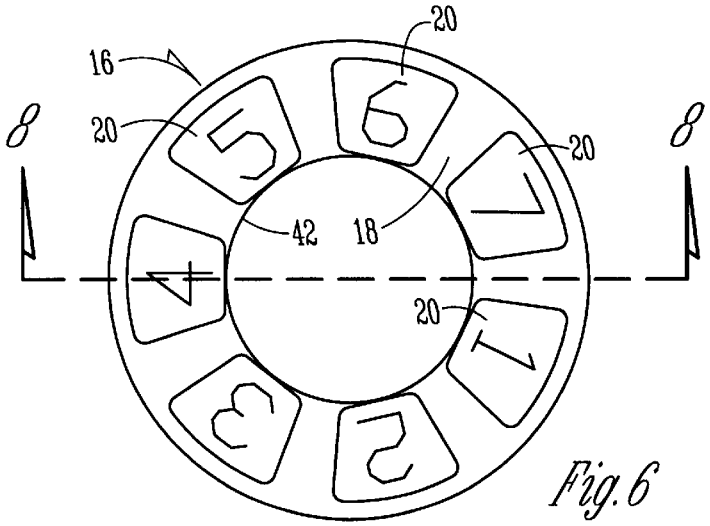
FIG. 6 is a top view of the body portion of the dosage indicator.
Figure 7:
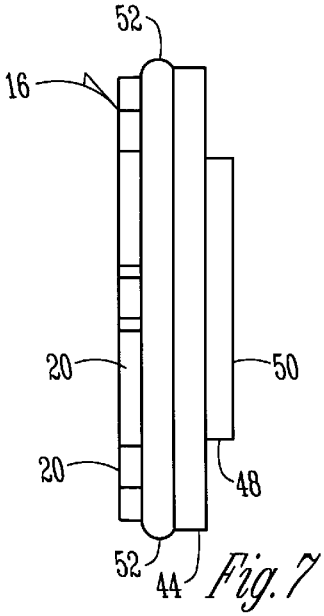
FIG. 7 is a side view of the body portion of FIG. 6.
Figure 8:
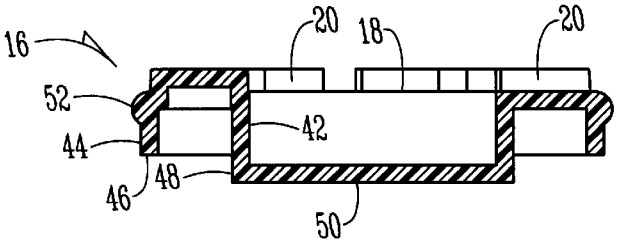
FIG. 8 is a sectional view taken along line 8—8 of FIG. 6.
Figure 9:
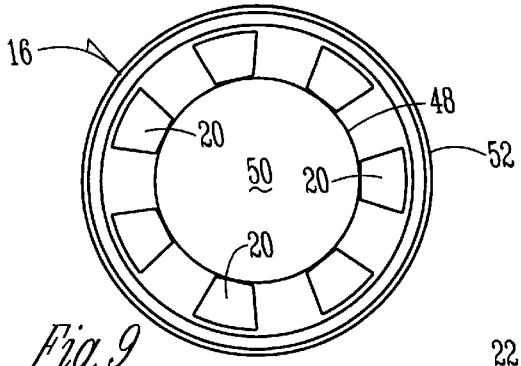
FIG. 9 is a top view of the dosage indicator.
Figure 10:
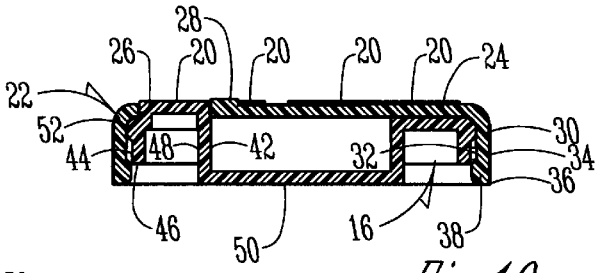
FIG. 10 is a sectional view taken along line 10—10 of FIG. 1 showing the dosage indicator in a closed position.
Figure 11:
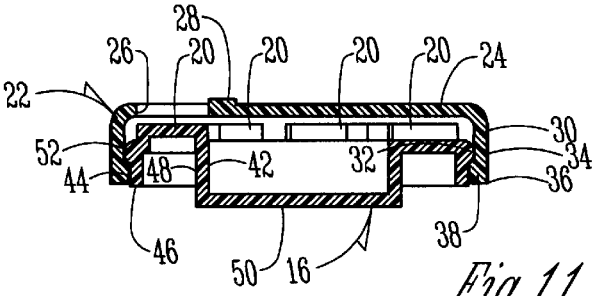
FIG. 11 is a sectional view similar to FIG. 10 showing the dosage indicator in an open position.
Figure 12:
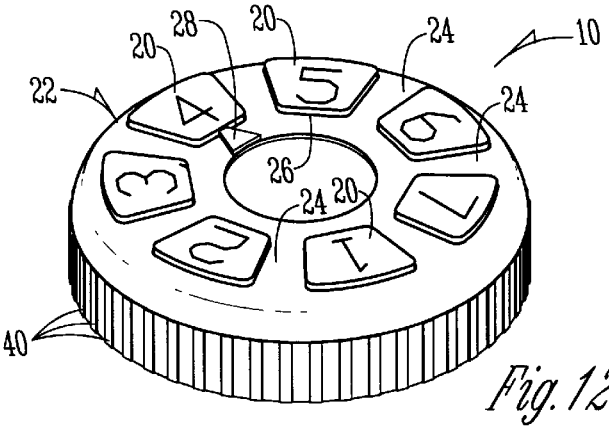
FIG. 12 an enlarged perspective view of the dosage indicator in a closed position.

The body portion 16 of the dosage indicator 10 is shown in more detail in FIGS. 6–8. A plurality of indicator tabs 20 are spaced apart in a circular fashion on the top wall 18 of the body portion 16. The top wall 18 includes an opening 42 therein. An annular side wall 44 extends from and below the periphery of the top wall to a bottom end 46. An annular main wall 48 extends from the top wall 18 about the periphery of the opening 42 and connects the top wall with an opposite bottom wall 50. An adhesive material may be provided on the bottom wall 50 to adhere the dosage indicator 10 to the cap 12 of a pill bottle 14 or other surface. An annular rib 52 is disposed about the periphery of the top wall 18 and along the annular side wall 44. When the body portion 16 is fit to the cap portion 22, the annular rib 52 abuts the inner surface 32 of the cap portion.

FIGS. 9–12 show the dosage indicator 10 with the cap portion 16 fit to the body portion 22. It is important to note that the cap portion 22 is movable between a closed position and an open position. In the closed position, the indicator tabs 20 of the body portion 16 matingly fit within the apertures 26 of the cap portion 22 and the annular rib 52 of the body portion abuts the inner surface 32 of the cap portion and is spaced apart from the annular ridge 38 (see FIG. 10). The annular ridge 38 extends below the bottom end 46 of the annular side wall 44 of the body portion 16 to secure the top wall 18 of the body portion against the upper wall 24 of the cap portion 22. In the open position, the indicator tabs 20 are disposed beneath the apertures 26 in the cap portion 22 and the annular ridge 38 acts as a stop and abuts the annular rib 52 of the body portion 16 (see FIG. 9). This loose fit enables the cap portion 22 to be rotated relative the body portion 16 in the open position to adjust the cap portion 22 such that the identification mark 28 points to an appropriate identification tab 20.

Figure 13:
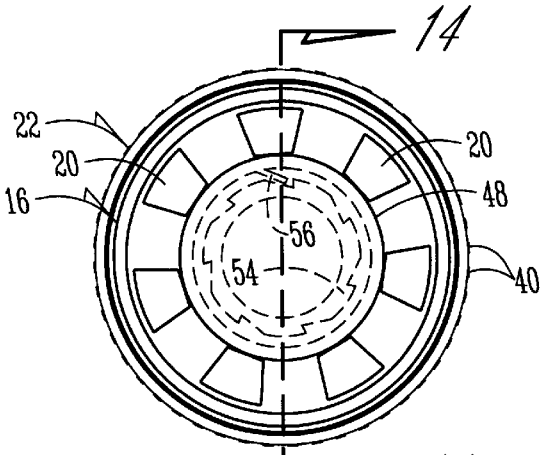
FIG. 13 is an exploded perspective view of an alternative embodiment of the dosage indicator.
Figure 14:
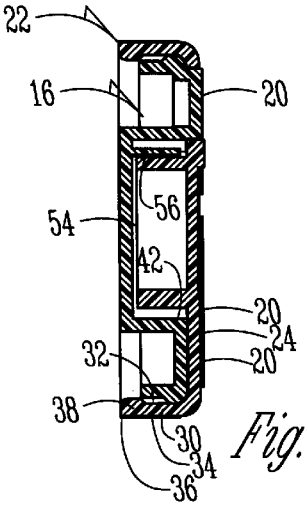
FIG. 14 is a sectional view taken along line 14—14 of FIG. 13.

An alternative embodiment of the dosage indicator 10 of the present invention is shown in FIGS. 13 and 14. Here, the dosage indicator 10 is modified such that the cap portion 22 includes a ratchet mechanism 54 and the body portion 16 includes a pawl 56 that extends from the annular main wall 48. The ratchet mechanism 54 is attached beneath the upper wall 24 of the cap portion 22 and is sized and positioned such that the ratchet mechanism engages the pawl 56 on the body portion 16. The ratchet mechanism 54 and pawl 56 restrict the cap portion 22 to rotation in only one direction while in the open position. This helps to ensure that the user will not erroneously reset the dosage indicator 10 to a date prior. Instead, the ratchet mechanism 54 only allows the user to rotate the cap portion to a future day.

Figure 15:
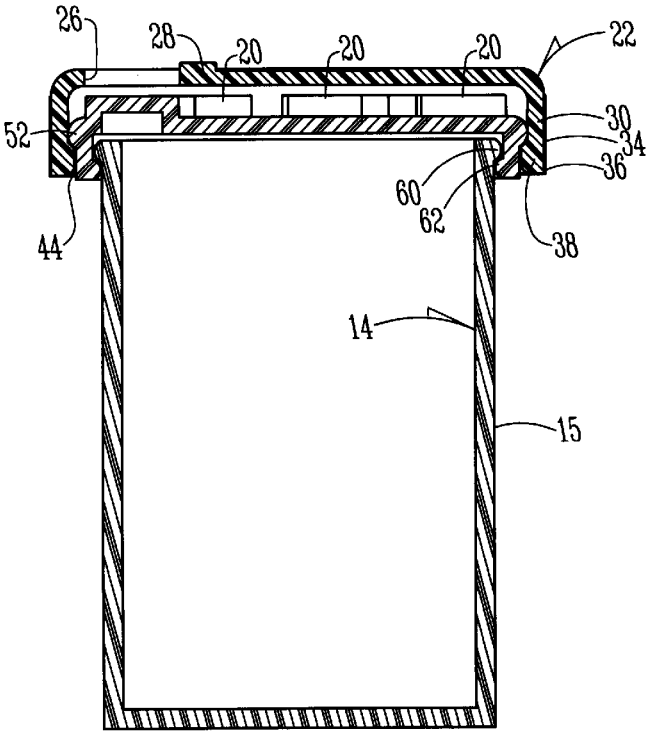
FIG. 15 is a sectional view, showing an alternative embodiment of the dosage indicator replacing the cap of the pill bottle.

As discussed previously, the dosage indicator 10 can be attached directly to the cap 12 of a pill bottle 14 (see FIG. 1). However, the dosage indicator 10 may be adapted such that the body portion 16 also functions as a cap 12 for the pill bottle 14. As shown in FIG. 15, the body of the pill bottle 15 is often designed with an annular rib 60 about the open end of the pill bottle 14. An annular ridge 62 extending inward from the bottom end 46 of the annular side wall 44 of the body portion 16 is added. This annular ridge 62 is disposed below the annular rib 60 of the pill bottle 14 and secures the body portion 16 to the pill bottle. Thus, when the cap portion 22 of the dosage indicator 10 has moved from the closed position to the open position, the body portion 16 remains fixed to the pill bottle 14.

Figure 16:
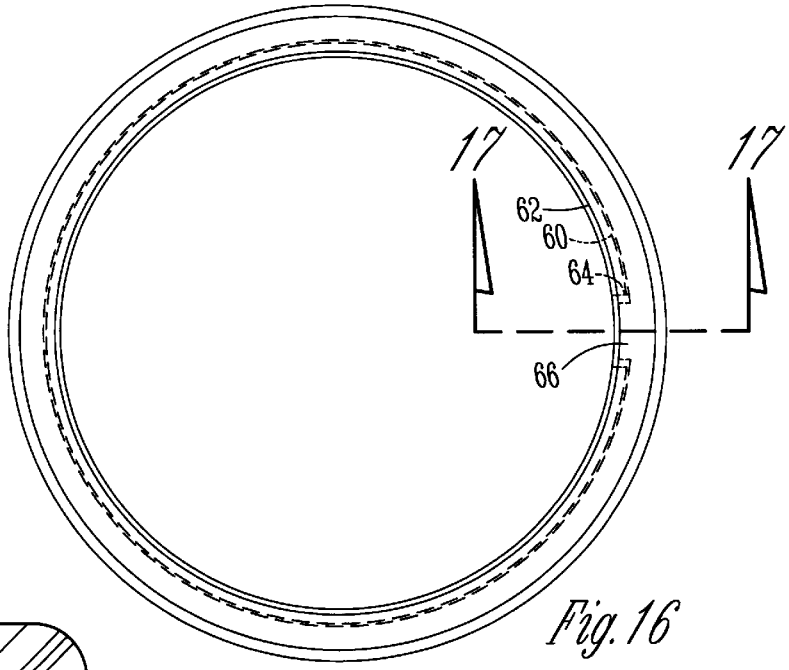
FIG. 16 is a bottom view of the dosage indicator of FIG. 15.

It has also been found useful to provide a recess 64 about a small portion of the annular rib 60 of the pill bottle 14 for purposes of stabilizing the body portion 16 of the dosage indicator 10 when the cap portion 22 is rotated (see FIG. 16). A corresponding detent 66 is provided on the body portion 16 and resides within the recess 64. Accordingly, the body portion 16 of the dosage indicator remains fixed when the cap portion 22 is rotated in the open position.

Figure 17:
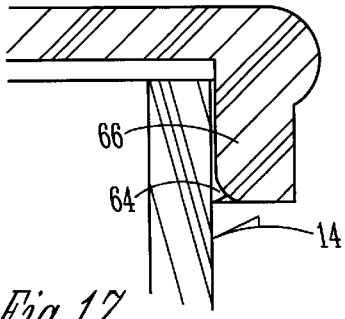
FIG. 17 is a sectional view taken along line 17—17 of FIG. 16.

The modified dosage indicator 10 as shown in FIGS. 15–17 essentially replaces the traditional cap 12 of the pill bottle 14. Of course, there are a myriad of different types of pill bottles and the dosage indicator could be similarly adapted to secure to any such pill bottle.

The dosage indicator 10 of the present invention is easy to use and provides a sure method for recording and remembering when medication was either taken or is next due. The method of reminding a person when to take medication using the medication dosage indicator 10 of the present invention is facile. First, the patient identifies the day of the week on the indicator tab 20 correspond ing to the identification mark 28. Next, the patient dispenses the proper medication for that particular day. Aft er t he medication is taken, the patient moves the cap portion 22 of the dosage indicator 10 from the closed position to the open position, and then rotates the cap portion so that the identification mark 28 points to the identification tab 20 corresponding to the next day when medication is to be taken. Finally, the patient moves the cap portion 22 from the open position to the closed position.

Whereas the invention has been shown and described in connection with the preferred embodiments thereof, it will be understood that many modifications, substitutions, and additions may be made which are within the intended broad scope of the following claims. From the foregoing, it can be seen that the present invention accomplishes at least all of the stated objectives.

What is claimed is:

1. A medication dosage indicator comprising:

a body portion having a circular top wall, a plurality of raised indicator tabs spaced apart in a circular fashion on said top wall, an annular side wall extending from and below the periphery of said top wall, and an annular rib extending laterally from said annular side wall; and a cap portion having a circular upper wall with a plurality of apertures sized and spaced apart to fit in a mating relationship with said raised indicator tabs, an annular edge extending from the periphery of said upper wall to a lower end, said annular edge at least partially encloses and abuts said annular side wall of said body portion, and an annular ridge disposed at said lower end of said annular edge and extending laterally inward therefrom, said annular ridge forming a stop against said annular side wall for securing said cap portion to said body portion;

said cap portion is movable between a closed position wherein said indicator tabs are disposed within said apertures and said annular rib and said annular ridge are spaced apart, and an open position wherein said indicator tabs are disposed beneath said apertures and said annular rib abuts said annular ridge, said cap portion being rotatable about said body portion in said open position.

2. The medication dosage indicator of claim 1 wherein said upper wall of said cap portion having an identification mark to identify a particular raised indicator tab corresponding to one of said apertures.

3. The medication dosage indicator of claim 1 wherein said body portion includes a bottom wall having an adhesive outer surface.

4. The dosage indicator of claim 1 wherein each of said indicator tabs having indicia to identify a day of the week.

5. The dosage indicator of claim 1 wherein said body and cap portions are integrally formed.

6. The dosage indicator of claim 1 wherein said body portion is suitable for use as a cap for a pill bottle.

7. A method for reminding a person when to take medication using a medication dosage indicator, said medication dosage indicator including a body portion having a circular top wall, a plurality of raised indicator tabs each identifying a day of the week spaced apart in a circular fashion on said top wall, and a bottom wall opposite said top wall; and a cap portion having a circular upper wall with a plurality of apertures sized and spaced apart to fit in a mating relationship with said raised indicator tabs, and an identification mark to identify a particular raised indicator tab corresponding to one of said apertures, said cap portion is movable between a closed position wherein said indicator tabs are disposed within said apertures and an open position wherein said indicator tabs are disposed beneath said apertures, said cap is rotatable about said body portion in said open position, said method comprising:

identifying the day of the week on said indicator tab corresponding to said identification mark;

dispensing the proper medication on the day of the week on said indicator tab corresponding to said identification mark;

moving said cap portion from said closed position to said open position;

rotating said cap portion to identify the next day for dispensing medication; and moving said cap portion from said open position to said closed position.

8. A medication dosage indicator comprising:

a body portion having a circular top wall with an opening therein, a plurality of raised indicator tabs spaced apart in a circular fashion on said top wall, a cylindrical wall extending from said top wall about the periphery of said opening, and a pawl extending inwardly from said cylindrical wall; and a cap portion having a circular upper wall with a plurality of apertures sized and spaced apart to fit in a mating relationship with said raised indicator tabs, and a ratchet mechanism attached to said upper wall disposed to engage said pawl;

said cap portion is movable between a closed position wherein said indicator tabs are disposed within said apertures and an open position wherein said indicator tabs are disposed beneath said apertures, said cap portion being rotatable about said body portion in said open position.

9. The medication dosage indicator of claim 8 wherein, said ratchet mechanism and pawl restrict rotation of said cap portion to one direction.

10. The medication dosage indicator of claim 8 wherein said cap portion and said body portion are each integrally formed.

11. The medication dosage indicator of claim 8 wherein said body portion is suitable for use as a cap for a pill bottle.

* * * * *